US007231672B2

(12) United States Patent
Thomas

(10) Patent No.: US 7,231,672 B2
(45) Date of Patent: Jun. 19, 2007

(54) UNDERGARMENT WITH POCKET

(76) Inventor: Gwen Vanessa Thomas, 1398 NW. 61st St. Apt. 9, Miami, FL (US) 33142

( * ) Notice: Subject to any disclaimer, the term of this patent is extended or adjusted under 35 U.S.C. 154(b) by 299 days.

(21) Appl. No.: 10/289,491

(22) Filed: Nov. 6, 2002

(65) Prior Publication Data

US 2004/0083538 A1 May 6, 2004

(51) Int. Cl.

| | |
|---|---|
| ***A41B 9/02*** | (2006.01) |
| ***A41D 27/20*** | (2006.01) |
| *A41D 1/08* | (2006.01) |
| *A41D 27/00* | (2006.01) |
| *A41D 7/00* | (2006.01) |

(52) U.S. Cl. ..... 2/400; 2/247

(58) Field of Classification Search ..... 2/400, 2/403, 406, 227, 228, 238, 67, 247–251; 450/89; 604/386, 385.01

See application file for complete search history.

(56) References Cited

U.S. PATENT DOCUMENTS 2,544,840 A * 3/1951 Kowatsch ..... 2/247
3,137,862 A * 6/1964 Mizerak ..... 2/247
4,145,762 A * 3/1979 Wallach ..... 2/67

* cited by examiner

*Primary Examiner*—Gloria M. Hale
(74) *Attorney, Agent, or Firm*—Robert M. Downey, PA

(57) ABSTRACT

An undergarment in the form of boxer shorts includes a concealed inside pocket on the front panel for holding valuables and other items such as, but not limited to, a credit card, a membership or I.D. card, paper and coin currency and keys. The pocket hangs freely on the inside of the boxer shorts and is secured to the front panel at a top open pocket mouth. A horizontal slit opening on the front panel, just below the waistband of the boxer shorts, communicates with the pocket mouth to permit placement and removal of the items carried in the pocket. A zipper or other closure mechanism is provided for securing the slit opening closed, thereby safely containing the items in the pocket. Opposing flaps along the horizontal slit opening on the outside of the front panel help to conceal the pocket mouth and closure mechanism.

3 Claims, 1 Drawing Sheet

UNDERGARMENT WITH POCKET

BACKGROUND OF THE INVENTION

1. Field of the Invention

The present invention relates to an undergarment with a pocket and, more particularly, to boxer shorts having a concealed pocket for securely and safely holding valuables and other items therein.

2. Discussion of the Related Art

When most people leave their home they usually carry several items on their person including a driver's license or other form of identification, money and one or more keys, as well as possibly at least one credit card, a banking card (e.g. a debit card or ATM card), and one or more membership cards. These items are typically carried in a wallet or purse. There are times, however, when it is not practical or safe to carry a wallet or purse when a person is away from home. For instance, work-out garments worn when exercising often do not include pockets which are suitable for carrying the above-noted items. In other instances, it might be desirable to conceal money, credit cards and other valuable items and documents when traveling away from home, and especially in instances wherein there may be a risk of exposure to crime.

Traditional pockets found on outer garments such as trousers, shorts, shirts and jackets, are not always a secure place to carry valuables and other items, such as those identified above. Because the pocket openings on these garments are often left open, when a person sits down the items contained in the pockets are prone to accidentally fall out. Not surprisingly, keys, money and other valuables are often lost when carried loosely in pants or jacket pockets. Further, the open visibility and ease of access to conventional pockets make them prime targets to crime.

Accordingly, there remains a need for a garment which includes a concealed pocket for carrying valuables and other items in a safe and secure manner. More specifically, there remains an urgent need for an undergarment, and particularly boxer shorts, which provides for a considerably large pocket which is concealed and which is structured and disposed to safely and securely contain one or more items therein including, but not limited to, credit cards, I.D. cards, membership cards, paper and coin currency, important documents, one or more keys and/or one or more items of jewelry.

SUMMARY OF THE INVENTION

The present invention is directed to an undergarment in the form of boxer shorts which includes a concealed inside pocket on the front panel for holding valuables and other items such as, but not limited to, a credit card, a membership or I.D. card, paper and coin currency and keys. The pocket hangs freely on the inside of the boxer shorts and is secured to the front panel at a top open pocket mouth. A horizontal slit opening on the front panel, just below the waistband of the boxer shorts, communicates with the pocket mouth to permit placement and removal of the items carried in the pocket. A zipper or other closure mechanism is provided for securing the pocket mouth closed, thereby safely containing the items in the pocket. Opposing flaps on the outside of the front panel help to conceal the pocket mouth and closure mechanism.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
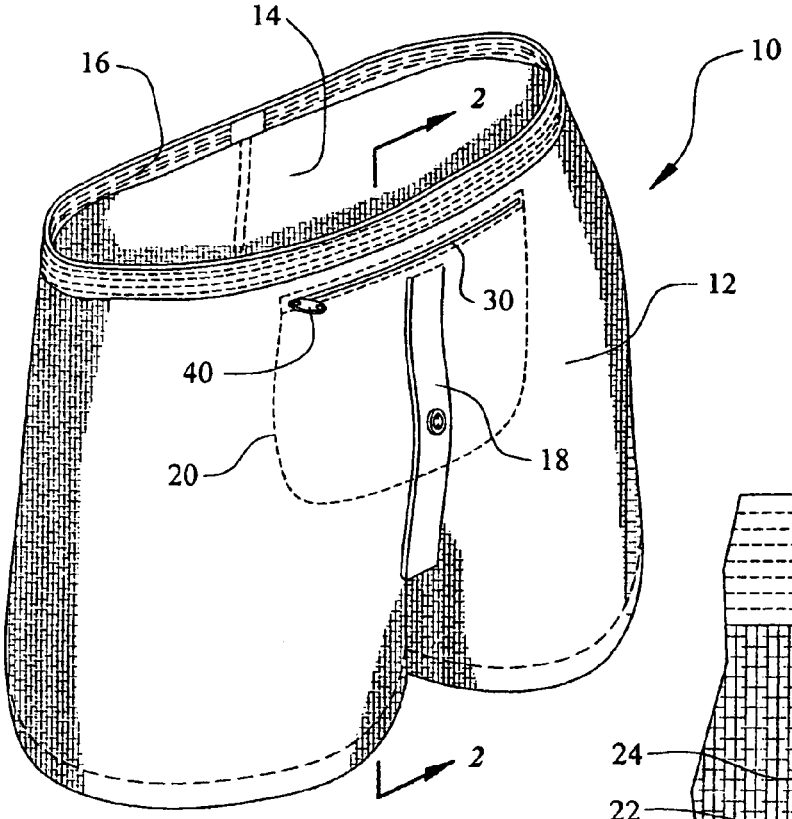
FIG. 1 is a top front perspective view of the boxer shorts of the present invention, wherein the concealed pocket is shown in phantom lines.
Figure 2:
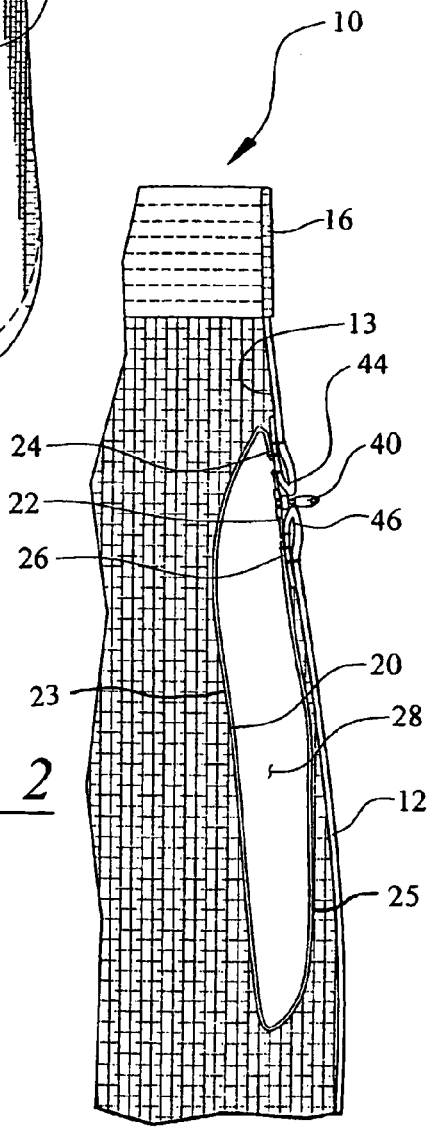
FIG. 2 is an isolated cross-sectional view taken along the plane of the line 2—2 in FIG. 1.

Referring to FIGS. 1 and 2 of the drawings, the boxer shorts of the present invention are shown and are generally indicated as 10. The boxer shorts 10 include a front panel 12, a rear panel 14, a waistband 16 and a fly opening 18 on the front panel.

As best seen in FIG. 2, a pocket 20 is secured to the inside 13 of the front panel 12. The pocket 20 includes a rear wall 23 terminating at a top first edge 24 and a front wall 25 terminating at a top second edge 26.The pocket 20 is stitched to the inside 13 of the front panel 12 along the opposite, opposing top first and second edges 24, 26 which surround a pocket mouth 22 near the top of the pocket 20. The rear pocket wall 23 and front pocket wall 25 hang freely from the stitched attachment at the top first and second edges 24, 26 behind the front panel 12 so that the pocket 20 is concealed from view when the boxer shorts 10 are worn on the user. A horizontal slit opening 30 in the front panel, between the waistband 16 and fly opening 18, is positioned and disposed in communicating alignment with the open pocket mouth 22 to facilitate placement and removal of items within the pocket interior 28 through the slit opening. A closure mechanism 40, such as a zipper, hook and loop fastener, snaps or other like means, is provided along the slit opening and/or open pocket mouth to facilitate opening and closing of the pocket mouth. Accordingly, when items are placed within the pocket interior 28, the closure mechanism 40 can be operated to a closed position, thereby safely securing and containing the items within the pocket, in concealment behind the front panel 12 of the boxer shorts 10 when worn on the user. Upper and lower flaps 44, 46 extend along the length of the horizontal slit opening 30 to conceal the pocket mouth 22 and closure mechanism 40. The upper and lower flaps 44, 46 are able to flex outwardly to reveal the slit opening, closure mechanism and open mouth of the pocket, thereby allowing items to be inserted and removed from the pocket interior.

While the instant invention has been shown and described in accordance with a preferred and practical embodiment thereof, it is recognized that departures from the instant disclosure are contemplated within the spirit and scope of the present invention as recited in the following claims and as interpreted under the doctrine of equivalents.

What is claimed is:

1. An undergarment comprising:

a pair of boxer shorts including a front panel with an outer side and an inner side, a rear panel with an outer side and an inner side, and a waistband;

a slit opening formed through said front panel;

a pocket secured to said inner side of said front panel and including an open mouth communicating with said slit opening;

a closure mechanism for selectively closing said pocket mouth to contain items within said pocket; and an upper flap member and an opposing lower flap member integrally formed with said front panel and flush with said outer side of said front panel, and said upper and lower flap members extending in adjacent parallel relation to one another in spaced relation below said waistband and along said slit opening, and said upper and lower flap members normally concealing said closure mechanism and said open mouth of said pocket, and said upper and lower flap members being structured and disposed to flex outwardly to reveal said closure mechanism and said pocket mouth to thereby enable operation of said closure mechanism an access through said pocket mouth and into said pocket.

2. The undergarment as recited in claim 1 wherein said pocket includes a front pocket wall and a rear pocket wall, said rear pocket wall terminating a top first edge and said front pocket wall terminating at a top second edge, said first and second topedges surrounding said pocket mouth, and said top first edge being attached to an inner side of said boxer shorts above said slit opening and said top second edge being secured to the inner side of said boxer shorts below said slit opening.

3. The undergarment as recited in claim 1 wherein said closure mechanism is a zipper.

* * * * *